US006993280B2

(12) United States Patent
Alberstadt et al.

(10) Patent No.: US 6,993,280 B2
(45) Date of Patent: Jan. 31, 2006

(54) CONNECTION BETWEEN THE FLANGE AND THE BODY OF A FUSER ROLLER

(75) Inventors: Wolfgang Heinrich Alberstadt, Stockstadt am Rhein (DE); Christian Compera, Schoenau (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/696,190

(22) Filed: Oct. 28, 2003

(65) Prior Publication Data

US 2004/0234307 A1 Nov. 25, 2004

(30) Foreign Application Priority Data

Nov. 11, 2002 (DE) ..... 102 51 101

(51) Int. Cl.
*G03G 15/20* (2006.01)

(52) U.S. Cl. ..... 399/330; 219/216; 347/156; 399/320; 399/328

(58) Field of Classification Search ..... 399/330, 399/320, 328; 347/156; 219/216; 29/724; 400/448; 384/565
See application file for complete search history.

(56) References Cited

U.S. PATENT DOCUMENTS

| | | | | |
|---|---|---|---|---|
| 2,633,627 A * | 4/1953 | Olmstead | 29/898.062 |
| 4,506,936 A * | 3/1985 | Miller | 384/569 |
| 6,224,166 B1 * | 5/2001 | Chen | 301/110.5 |
| 2002/0051662 A1 * | 5/2002 | Nagafuji | 399/330 |

FOREIGN PATENT DOCUMENTS

| | | |
|---|---|---|
| JP | 2000214712 A * | 8/2000 |
| JP | 02000214712 A * | 8/2000 |
| JP | 02002108119 A * | 4/2002 |

* cited by examiner

*Primary Examiner*—Arthur T. Grimley
*Assistant Examiner*—Peter Lee
(74) *Attorney, Agent, or Firm*—Lawrence P. Kessler

(57) ABSTRACT

A fuser roller for a printing machine that is equipped with internally located heating elements and has a cylindrically shaped body that is closed off at each end by flanges. At least one connecting element, that is moveable in a rolling motion, is provided between the body and the flanges. A spring plate urges the flange, via an offset that has a chamfer, against the connecting element that is located inside an annular groove. The annular groove can also have a chamfer. Changes in the connection can be balanced out by movements of the connecting elements and commensurate pulling up of the flange by the spring plate.

7 Claims, 5 Drawing Sheets

CONNECTION BETWEEN THE FLANGE AND THE BODY OF A FUSER ROLLER

FIELD OF THE INVENTION

The invention concerns a fuser roller for a printing machine that is equipped with internally located heating elements and has a cylindrically shaped body that is closed off at each end by flanges.

BACKGROUND OF THE INVENTION

In a printing machine, for example, in an electrophotographic printing machine, toner is transferred onto a printable material by an inking device. To fuse the toner to the printable material the toner is liquefied by the application of heat simultaneously with the pressure, so that it flows into the printable material and becomes intermeshed therein.

For the simultaneous application of heat and pressure, the printable material is transported by conveyers to the nip area between a heatable fuser roller and a backing roller. The printable material is often in the form of sheets. These sheets are often made of paper that can be constituted such that assimilation of the toner is facilitated.

In a fuser mechanism of this type the fuser roller is heated and at the same time it and the inking roll are pressed against one another. For this operation the fuser roller can be installed to be stationary and the inking roll can be moveable in such a way that it is pressed against the fuser roller only for the period of time during which printable material is in the space between the fuser roller and the inking roll.

The fuser roller includes a hollow, cylindrically shaped metal body that can have a different coating depending upon the manufacturing process and its intended use. The coating should in any case be able to yield at least to some degree to the pressure of the inking roll. This will assure that the toner remains for a longer period of time within the nip area between the inking roll and the fuser roller.

In most cases the fuser roller is heated from the inside outwards. The heat source in such cases is usually an infrared radiator. A heat source is located inside the fuser roller. It heats the cylinder shaped body of the fuser roller, preponderantly without touching. Flanges are located at the two ends of the body. The flange and the body are usually connected by a press fit or by welding, followed by reforming of the flange and the body. This results in rigid connections.

The body of the fuser roller and its coating are such that the best possible heat transfer from inside outwards is assured. Within the nip area between the fuser roller and the inking roll, the outer surface of the fuser roller reaches a temperature between 150° C. and 220° C. during operation. This temperature is sufficient (1) to melt the toner on the outer surface of the printable material and then (2) with the support of the pressure that is applied to work it into the printable material, where it later fuses following a cooling period.

When the fuser roller is heated, expansions occur that generate stresses on the connection points between the body and the flanges. The effects of these stresses can, e.g., be that the concentric operation of the fuser roller is adversely affected. Also, the connections between the body and the flanges are stressed so that their durability is reduced. The quality of the fusing characteristics of the entire fuser mechanism can be adversely affected by warping of the outer surface of the fuser roller.

SUMMARY OF THE INVENTION

Therefore, the object of the present invention is to increase the durability of the connections between the flange and the cylindrically shaped body of an internally heated fuser roller, and to prevent the occurrence of warping and stresses. According to the invention, the object of the invention is achieved by a fuser roller, which has a connection between the body and the flange that has at least one connecting element that is movable by a rolling motion.

The connection between the body and the flange is provided on both ends of the body; the invention can thus pertain to all connection points. In the interest of a better description only one connection between the flange and the body will be described below. In a similar manner several connecting elements can in accordance with the invention be involved in the connection. In particular, provision can be made for the, connecting elements according to the invention to be located within the entire connection area between the flange and the body. The following will describe only one connecting element, but that does not mean that the invention is limited to only one connecting element.

It is advantageously possible that, by a connecting element that is located between the body and the flange and is movable by a rolling motion, stresses can be eliminated and possible warping of the flange and/or body can be balanced out or avoided. Due to the fact that the connecting element that is moveable by a rolling motion yields to the prevailing forces, the connection adapts to new geometric relationships and the warping energy building up in the area of the connection is minimized.

In an advantageous further development of the invention, provision is made for the connecting element according to the invention to be essentially approximately ball (spherical)-shaped. A spherical shape for the connecting element assures that movement of the connecting element within the connection point between the flange and the body occurs with as little friction as possible. The danger that the connecting element will tilt is decreased. In that it changes its position commensurately, the ball-shaped connecting element at the ends of the roller is advantageously able to balance out, in every direction possible, changes in the sizes of the body and the flanges.

Provision is also made according to the invention that the approximately ball shaped connecting element that is moveable by a rolling motion can be arranged in the form of circular segments. By this arrangement, it can be advantageously made possible that the forces working upon the connecting element are evenly distributed over a relatively large area of the element. If exact ball shaped connecting elements are used, each of them would make contact with the flange and the body at only one point. In such case the forces working on the connecting element, which arise for example through changes in the length of the body and/or the flange due to the influx of heat to the fuser roller, would work through only this one point. The resulting pressure would then be proportionately large.

To establish the connection between the flange and the body, provision is preferably made according to the invention, for the body to have an annular groove with a half-circular cross section in the outer range of where the flange and the body are connected, and this groove holds the connecting element. This annular groove may be located according to the invention on the inner side of the body and form a circle around the axis of the body. This annular groove permits the body to be such that a nearly sealed connection with the connecting element that conforms to the invention is assured. The approximately ring shaped connecting element can be fitted into such an annular groove. Consequently, provision has been made according to the invention for the annular groove to have a diameter that is matched at least to the cross section of the connecting element.

In a further development of the invention provision is made that the flange can be inserted inside the body at the end of the body. This permits the advantage of a precisely measured connection between the flange and the body, which is relatively flexible with respect to changes in the cross section or length of the body, in particular. Provision is thereby made according to the invention for part of the flange to be located behind the connecting element that is moveable by a rolling motion. The connecting element is located for its part in the annular groove provided. In case a change in cross section or length occurs, which can for example occur as the result of an influx of heat, the connecting element can move such that it rolls to follow the movements of the expanding flange and body and can thus continue to assure a connection between the two, whereby a nearly sealed connection between the connecting element and the annular groove in the body is maintained.

A spring plate, is preferably provided to be placed, on the outer side of the end of the body. The flange inserted into the body can be held in place by this spring plate. In this way at least one part of the flange described above will be located on the side of the connecting element that faces toward the interior of the body. The connecting element itself is located inside the annular groove, thus assuring the connection between the flange and the body. The spring plate according to the invention can prevent the flange from slipping into the body. The spring plate is firmly in place, e.g., connected to the body with screws and lying against the end of the body. In this way, a connection between the body and the flange that seals off the inner area of the fuser roller is achievable.

The advantage of a flexible connection between the flange and the body is assured by the use of a spring plate. A certain tug in the direction of the front end of the fuser roller is exerted on the flange by the spring plate. By this tug, the flange is pressed against the connecting element from the inner side of the fuser roller. If, then, geometrical changes in the connection occur, e.g., because of heat, the spring plate can at least support an adaptation of the connection to these new conditions. If, for instance, the body expands in relation to its original position, the annular groove will then be located in relation to its former position farther toward the end of the fuser roller. The connecting element will then move so as to follow the position of the annular groove, in which it is located. Consequently the flange will then be brought up by the tug exerted by the spring plate, so that its position can then adapt itself to the changed geometrical conditions of the connection.

In an advantageous further development of the invention, provision is made for the flange to have on the side that faces toward the end of the body a quarter circular offset that is adapted to the shape of the connecting element. This offset is located on the part of the flange that protrudes past the connecting element and it faces toward the connecting element.

In this way, in the connection between the connecting element and the flange a nearly form fit is achieved. The pressing of the inner part of the flange against the connecting element will thus generate less friction. The direction in which the flange now works on the connecting element is thus more radially oriented. The stability of the connection between the flange and the body, which is represented by the connecting element, becomes further increased.

If the annular groove on the body side is precisely in the shape of a half circle, and the offset on the flange side is precisely in the shape of a quarter circle, an undesirable tilting of the connecting element against the edges of the annular groove and/or the offset can occur under certain circumstances. This can then lead to a concentricity fault in the fuser roller. According to the invention, this can be prevented by chamfers on the edges of the half-circular annular groove and/or the quarter-circular offset.

In a further embodiment of the invention, the chamfers can have an angle between 0° and 45° relative to the vertical. The chamfers are located on the two edges of the half circular annular groove and on the edge of the quarter circular offset that faces the connecting element. Preferably according to the invention, provision is made for a range of angles between 15° and 20°. In this range the freedom of movement of the connecting element is still limited such that, practically speaking, one can still assume the presence of a form fit. If the angle is substantially less it is possible that a concentric fault cannot always be prevented. If the angle is substantially greater, then it is possible for the connecting element to be forced out of the annular groove.

In an advantageous further development of the invention, heat ray reflecting reflector elements are provided on the side of the flange that faces the interior of the body. The heat source inside the fuser roller also radiates its output at least partly toward the end areas. This output raises the temperature of the flange and is dissipated outward via the flange. This results both in a loss of output and an undesirable influx of heat into the flange. This influx of heat can lead to warping of the flange and to stresses between the flange and the body. This output is reflected back into the interior of the fuser roller by reflector elements incorporated in the present invention. In this way the flange is protected from an undesirable influx of heat and the reflected output can be routed to the body. In addition, provision can be made for the reflector elements to be positioned at such an angle in relation to the plane of the flange that the radiated heat is reflected directly onto the inner side of the body of the fuser roller. In this way the flange is protected from direct exposure to the heat source and the efficiency of the fuser roller can be improved. In an advantageous embodiment, in order to achieve favorable characteristics of reflection, the reflector elements are formed on a reflector plate as ring-shaped reflector segments.

BRIEF DESCRIPTION OF THE DRAWINGS

Example embodiments, from which further inventive characteristics can also be derived and to which, however, the scope of the invention is not limited, are shown in the drawings. The drawings show as follows.

DETAILED DESCRIPTION OF THE INVENTION

Figure 1:
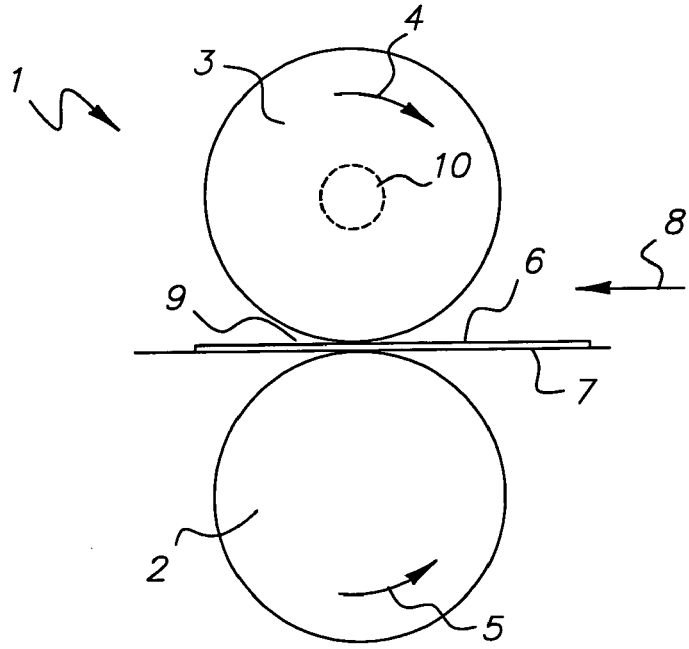
FIG. 1 is a schematic view of a fuser mechanism inside a printing machine.

FIG. 1 shows a schematic view of a fuser mechanism 1 inside a printing machine (details of the printing machine are not shown). The printing machine can be an electrophotographic printing machine, for example. A sheet 6 is located on a conveyor belt 7 and is transported in the direction shown by arrow 8 into the nip area between a fuser roller 3 and an inking roll 2. The fuser roller 3 and the inking roll 2 are rotating in the directions shown by arrows 4 and 5. They are turning in the sheet's direction of movement 8. A heat source 10 that is located on the axle of the fuser roller is inside the fuser roller. This fuser mechanism, as it is shown here, is in principle already known from prior art.

Figure 2:
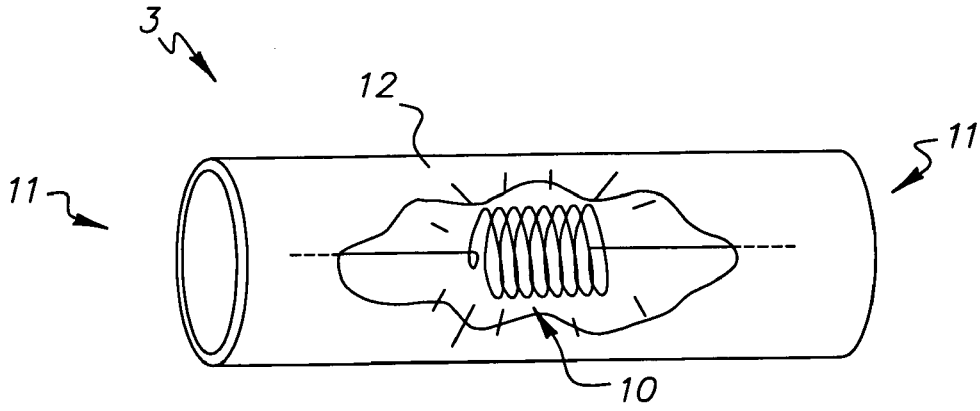
FIG. 2 is a fuser roller with a graphic cutout that allows the heat source to be seen.

In FIG. 2, the fuser roller 3 from FIG. 1 is shown. This is a lateral view and it contains a graphic cutout of the fuser roller 3, so that the heat source 10 is discernable inside the fuser roller 3. The flanges 11 are located on the ends of the fuser roller 3. The flanges 11 are connected to the body 12 of the fuser roller 3.

Figure 3:
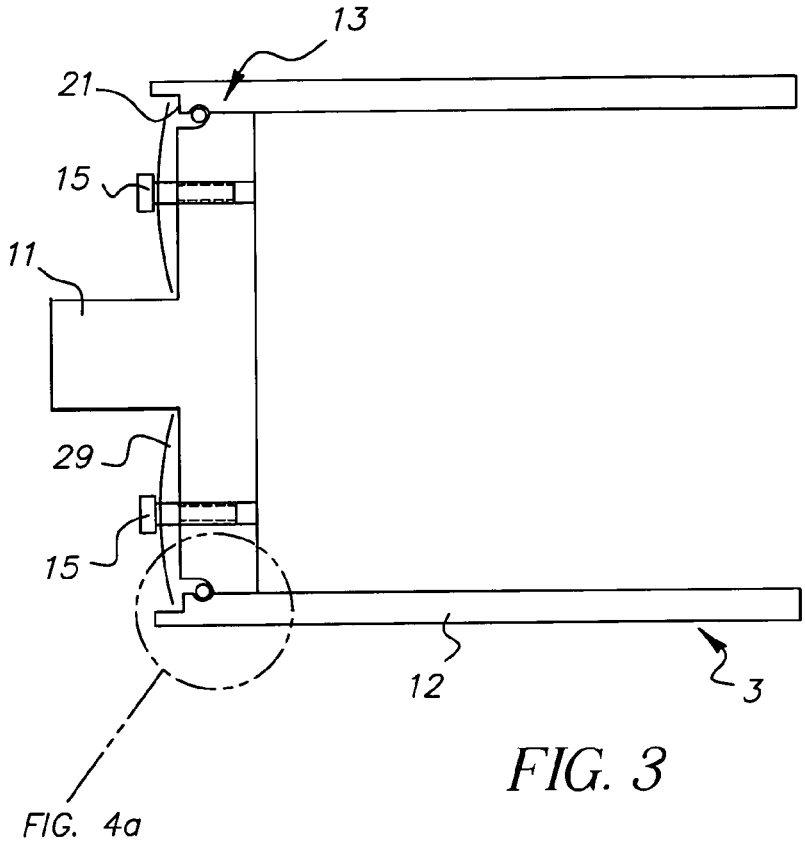
FIG. 3 is a segment from a longitudinal section through the fuser roller.

FIG. 3 shows a segment from a longitudinal section through the fuser roller 3. Shown here, in particular, is a connecting point between a flange 11 and the body 12 of the fuser roller 3. A connecting point can be seen in the area 4*a* of FIG. 3. The connection of the flange 11 and the body 12 is established via a connecting element 13. A more descriptive view of this connecting point can be seen in FIG. 4*a*. The flange 11 is shaped such that it fits into the body 12. The diameter of the part that fits in the inside is sufficient to virtually fill up radially the hollow space of the body 12. The diameter of the flange 11 decreases toward the end of the body 12. A free space thus exists between the flange 11 and the inner side of the body 11, which is large enough to hold the connecting element 13, whereby the connecting element 13 rests specifically in an annular groove 14 in the body 12.

Bored holes for screws 15 are located in the flange 11. These bored holes are arranged radially around the center point of the flange 11. A spring plate 29 is located on the outward facing side of the flange 11. It is attached to the flange 11 by the screws 15. The spring plate 29 lies on the end of the body 12. A shoulder 21 is available on the face of the body's end for this purpose. In the configuration shown here the spring plate has an opening in its mid-area to accommodate an outwardly projecting part of the flange 11. This outer part of the flange 11 can be provided, e.g., with a connection to the rest of the printing machine that is not shown here. The fuser roller 3 can be set in rotation via this connection, or various electrical contacts between the fuser roller 3 and the rest of the printing machine can be made available. The heat element 10 that is located inside the fuser roller 3 can be operated in this way, or other elements not shown here, such as sensors, can be actuated or read.

By firmly screwing down the spring plate 29 to the flange 11, while at the same time the spring plate 29 is placed on the shoulder 21, one assures that the flange 11, while yielding to a certain extent, is secured against slipping farther into the inside of the body 12. By the spring plate 29, the part of the flange 11, that fits into the inside of the body 12, is pressed from behind against the connecting element 13. This connecting element 13 is located in the annular groove 14 such that the flange 11 can also not move farther toward the end of the body 12. Consequently, by the form fitted shapes of the flange 11, the connecting element 13, and the body 12, the flange is connected with great stability to the body 12.

Figure 4A:
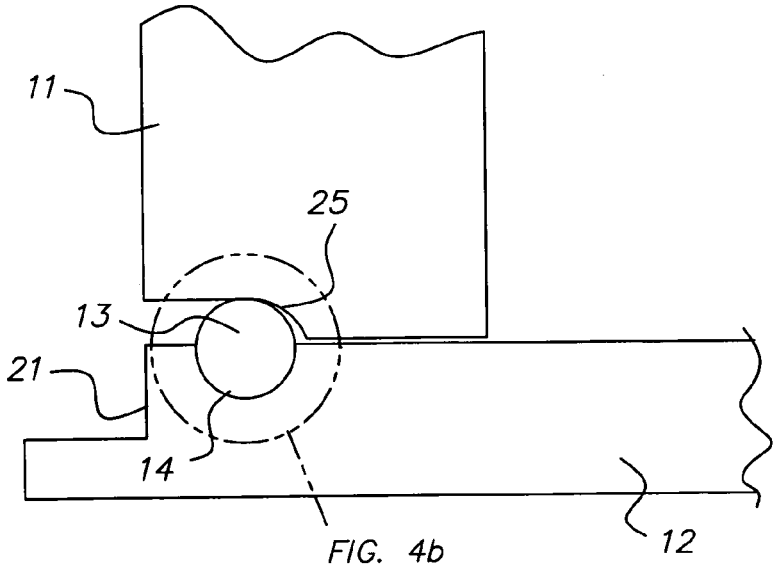
FIG. 4*a* is an enlarged view of area 4*a* from FIG. 3.

The area 4*a* from FIG. 3 shows the area in which the connection between the flange 11 and the body 12 is made. The connecting element 13, in particular, is located here. An enlarged view of this segment is shown in FIG. 4*a*. For reasons of clarity, the spring plate 29 is not shown in FIG. 4*a*.

The connecting element 13 is located in a space between the flange 11 and the inside of the body 12. The body 12 has here a half-circular annular groove with a diameter that is commensurate with the width of the connecting element 13. The connecting element 13 here is a ball shaped element with approximately the same diameter as the annular groove 14.

In other exemplary embodiments, connecting elements 13 that have a circular cross section but a different longitudinal dimension may be used. In such cases it is expected that the diameter of the annular groove 14 will be commensurate with the diameter of the circular cross section of such a connecting element.

The shape of the flange 11 is such that, in the area that lies behind the connecting element, it extends across the entire hollow space of the body 12. The distance between the flange 11 and the body 12 is at least so small that even the part of the connecting element 13 that projects outside the annular groove cannot slip between the flange 11 and the body 12. The shape of the flange 11 changes in the area inside of the body 12 that lies closer to the front end of the fuser roller. Here, the flange has an offset on the side facing the body 12, such that it tapers to such an extent that now the space between the flange 11 and the body 12 is large enough to hold the connecting element 13 while it is located in the annular groove 14. The offset 25 is defined such that it corresponds to a quarter circle whose radius approximates that of the connecting element 13.

Figure 4B:
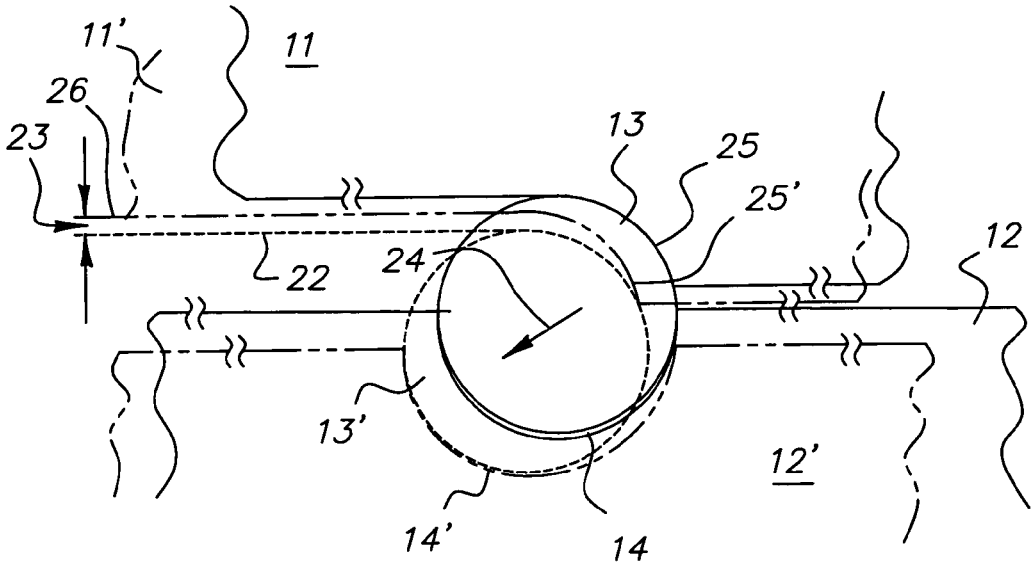
FIG. 4*b* is a detailed view of area 4*b* from FIG. 4*a;*

FIG. 4*b* is a detailed representation of area 4*b* from FIG. 4*a*. In addition to a representation of the area of the connection between the flange 11 and the body 12, which is also shown in FIG. 4*a*, (corresponding to a state at nearly room temperature), the dotted line shows the position of the flange 11', the connecting element 13', and the body 12', as would be the case at a metal temperature of 220° C. The described position at room temperature is shown in solid lines.

For the change of position from room temperature to 220° C., it was assumed that the flange 11 will expanded by 0.6 mm and the body 12 by 1.0 mm, versus the situation at room temperature. In this process the expansion occurs in both the horizontal and vertical directions. Altogether, therefore, a change occurs in the geometric relationships of the connection between the flange 11 and the body 12. The flange 11 expands in the vertical direction so that it also changes the diameter of the body 12. For the change in length of the body 12, a change of 1.0 mm was assumed here, by which the center point of the annular groove moved. The flange 11 is shown in its new position by 11'. The same applies to annular groove 14 (14'), the body 12 (12'), the connecting element 13 (13'), and the offset 25 (25').

Thus, the connecting element 13 changes its position by a rolling motion in the direction of the arrow 24. By the tightened spring plate 29, the flange 11 is then pulled so far toward the end of the body 12, that it follows the change of position of the connecting element 13. Then, in its new position the connecting element 13' still lies between the flange 11' and the body 12' such that they are tightly connected together with no space between them. The point of contact between the connecting element 13' and the offset 25' shifts to a point that lies below the highest point of the connecting element 13'. This results in a gap 23 between the uppermost point on the connecting element 13' and the flange 11'. To better represent this gap 23 a line 22, which represents a tangent to the uppermost point on the connecting element 13', was introduced into the drawing. A line 26 has also been added here. It represents an extension of the lower border of the flange 11' behind the connecting element 13'.

The width of the gap 23 is dependent upon the temperature of the fuser roller. Different geometric changes occur as a function of temperature. At the temperatures expected to prevail during the fusing process, it cannot be assumed that a deterioration of the connection between the flange 11' and the body 12' will occur as the result of a gap that is too wide. In a hypothetical case whereby the length of the body 12' changes in length by 1.0 mm in the direction of the face of the one end, and the radius of the flange 11' changes by 0.1 mm, the change in the width of the gap 23 will be in the range of approximately 0.1 mm. Where the width of the gap 23 is in this order of magnitude, the connecting element 13' will continue to lie firmly against flange 11'. Because at the same time it also lies firmly in the half circular annular groove 14', a firm and stable connection between the flange 11' and the body 12' continues to be assured.

Figure 5A:
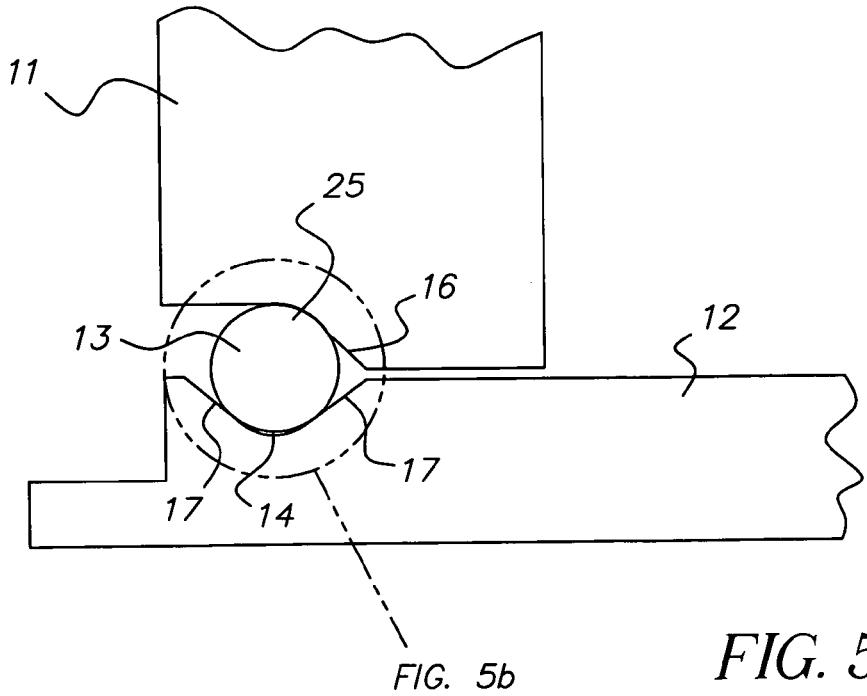
FIG. 5*a* is a segment of a fuser roller as shown in FIG. 4*a* with chamfers.

FIG. 5*a* shows a segment of a fuser roller as in FIG. 4*a* with an embodiment of the invention to include chamfers 16 and 17. Similar to the description relative to FIG. 4*a*, here, too, the connecting element 13 is located inside the annular groove 14 between the flange 11 and the body 12. Here, too, the flange 11 has an offset 25 whose shape is essentially quarter circular. The difference of the embodiment shown here with that described relative to FIG. 4*a* lies in the shaping of the annular groove 14 and the offset 25. Here, chamfers 16 and 17 have been added. The chamfer 16 is located in the area of the offset 25 and lies toward the inside of the fuser roller 3. Chamfers 17 are located in the area of the annular groove 14 on both edges of annular groove 14.

The chamfers 16 and 17 each form an angle of preferably 15° to 20° with the respective normal of the plane surface. In the present invention this angle can range from 0° to 45°. In order to provide a better representation of chamfers 16 and 17 no attempt has been made here to show the precisely correct angle. The angle shown here was selected arbitrarily and intentionally made larger so that the chamfers 16 and 17 can be easily recognized. If the angle of chamfers 16 and 17 were 0°, then this would indicate that no chamfers exist, and that the annular groove 14 and the offset 25 each possessed an edge with a right angle to the respective surface of each.

The chamfers 16 and 17 allow the connecting element 13 to roll more easily on the surfaces of the annular groove 14 and the offset 25. As a consequence a possible tilting of the connecting element 13 on the edge of the annular groove or the offset 25 and a consequential faulty concentric running of the fuser roller 3 can be avoided.

Figure 5B:
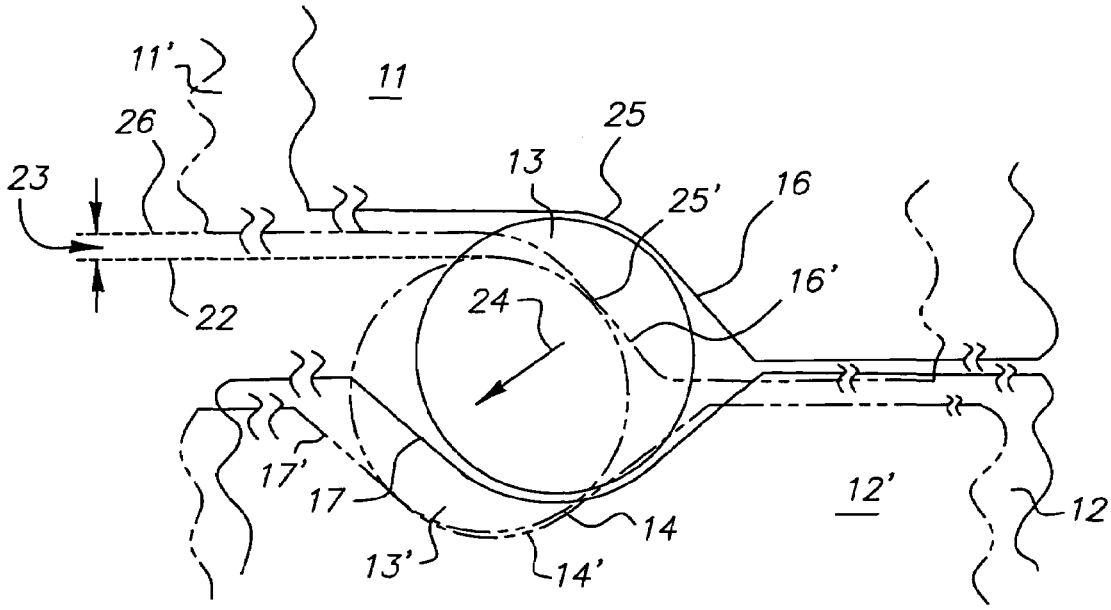
FIG. 5*b* is a detailed view of area 5*b* from FIG. 5*a;*

In FIG. 5*b* a detailed representation of the area 5*b* from FIG. 5 is shown. As was the case in FIG. 4*b* a position at 220° C. is shown to supplement the view of the position of the connection between the flange 11 and the body 12 at room temperature. FIG. 5*b* shows the position at room temperature with a solid line and the position at 220° C. with a dotted line. FIG. 5*b* is a schematic representation to show the changes in position. It is not true to scale. The objects at the 220° C. position are also identified by broken lines leading to their reference numbers.

When the same shifting of the flange 11 and the body 12 occurs here as in FIG. 4*b*, the result is also a gap 23. The width of the gap is approximately 13% greater than the gap in an example embodiment without chamfers 16 and 17, and in an actual case would be about 1.13 mm with a 1.00 mm change in length of the body 12' and a 0.60 expansion of the flange 11'.

At this expansion of the flange 11' and the body 12', the connecting element 13' still lies against chamfer 16' of the offset 25'. Even when larger expansions occur a commensurate positioning continues to be assured, and no tilting of the connecting element 13' onto the edge of offset 25' takes place. By the prevailing forces, in particular the tug of the spring plate 29, the flange 11' is pressed up against the connecting element 13' such that the orientation of the effects produces a 90° angle to the plane of the offset 25', or to the chamfer 16' of the offset 25'. The same applies to further transfer of force by connecting element 13' to chamfer 17' of the annular groove 14'. The transfer of force is hereby linear through the connecting element 13' so that it cannot result in torsional moment around an edge.

In the case of an arrangement such as is shown in FIG. 4*a* or 4*b*, under certain circumstances torsional moment on the connecting element 13' can result. The connecting element 13' continues to lie here on the edge of annular groove 14'. The prevailing forces cause a force vertical to an axis of inertia of the connecting element 13', whereby this axis lies here vertical to the edge of the annular groove 14'. Because of this torsional moment, a tilting of the connecting element 13' cannot always be avoided. A further adaptive rolling of the connecting element 13' can be prevented and the connection between the flange 11' and the body 12' can be adversely affected; at least faulty concentric running of the fuser roller 3 cannot always be precluded.

Figure 6:
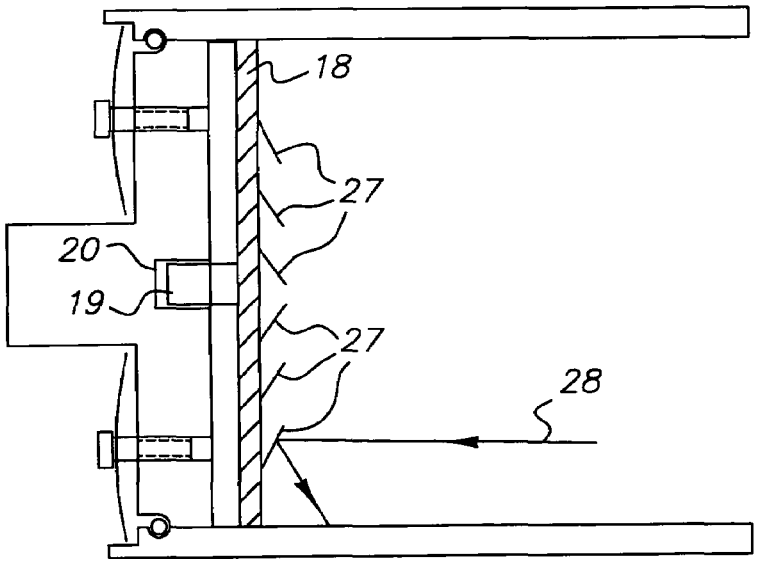
FIG. 6 is a segment of the fuser roller as shown in FIG. 3 with an integrated reflector plate.

In FIG. 6, a segment of an end of the fuser roller 3 along with an added, integrated reflector plate 18 may be seen. This segment is the same as that shown in FIG. 3. The reference numbers that identify the same objects as shown in FIG. 3 have been left out here for the sake of simplicity. Added here on the inside of the fuser roller 3 and on the inward facing side of the flange 11 is a reflector plate 18. A drilled hole 20, into which a dowel 19 affixed to the reflector plate 18 is fitted, has been provided in the flange 11 for attaching the reflector plate 18. This dowel 19 can, e.g., be threaded for insertion into the bored hole 20. Using a dowel 19 to install the reflector plate 18 on the flange 11 makes it possible to easily replace the reflector plate as needed.

A few of the reflector segments 27 are shown on the reflector plate 18. The individual reflector segments 27 form an angle with the plane of the reflector plate 18 so that each of them is aimed at the inside walls of the fuser roller 3. In this way heat rays 28 that are emitted from the heat source 10 toward the flange 11 are reflected directly toward the inside walls of the body 12 and can thus contribute to heating the outer coating of the fuser roller 3, and consequently also contribute to fusing the toner on a sheet 6.

Figure 7:
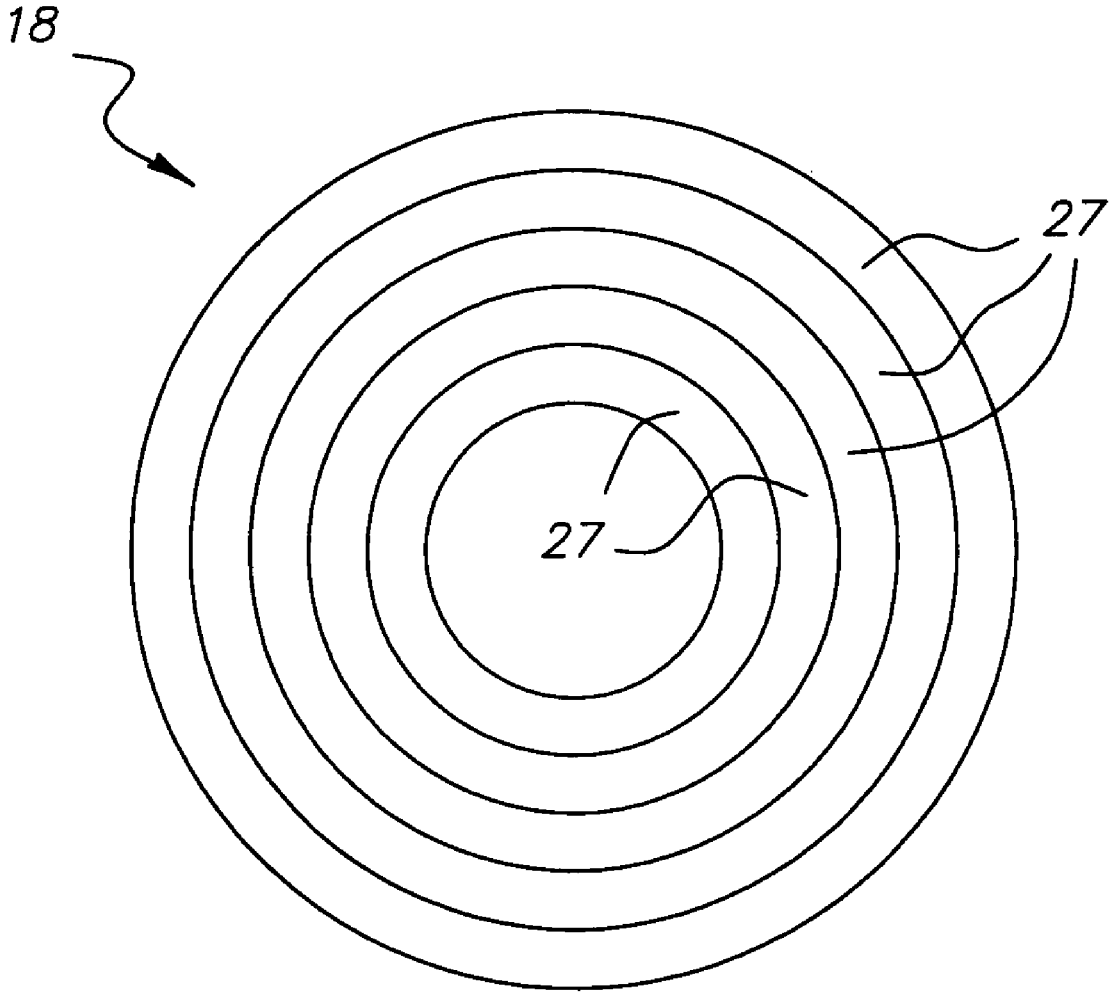
FIG. 7 is an overhead view of the reflector plate with a partial view of reflector segments.

FIG. 7 shows an overhead view of the reflector plate 18 with partial representation of reflector segments 27. The reflector segments 27 are circular segments that are arranged concentrically around the center of the reflector plate 18. The center of the reflector plate 18 should coincide with the center of the flange 11. To provide a better view not all of the reflector segments 27 that are affixed to the reflector plate are shown; only an illustrative few are shown.

According to the invention, the insertion of the flange 11 into the body 12 and the connection between the flange 11 and the body 12 should be such that, first of all, the flange 11 is inserted into the body 12. The area of the flange 11 with the greatest expansion up to the offset 25 should then lie behind the annular groove 14. In this way it is possible to then insert the connecting elements 13 into the space between the flange 11 and the body 12. In doing so one must be careful to assure that all of the connecting elements 13 ultimately lie in the annular groove 14.

Now the spring plate 29 can be placed on the shoulder 21 on the end of the body 12. Using screws 15, the spring plate 29 should be attached to the flange 11. When these screws 15 are tightened, the offset 25 of the flange 11 will be pressed against the connecting elements 13. Since the connecting elements 13 lie inside the annular groove 14, they will be clamped in by this action, while the spring plate 29 allows a certain amount of flexibility. This applies whether or not chamfers 16 and 17 are present. Consequently, having been attached with screws to the flange 11, placed upon the shoulder 21, and pressed against the connecting elements 13 inside the annular groove 14, the spring plate 29 assures a stable connection between the flange 11 and the body 12 of the fuser roller 3.

When the fuser roller 3 is heated, the flange 11 and the body 12 expand. The connecting elements 13 can then shift by a rolling motion into the new positions of the annular groove 14' and the offset 25'. Because the flange 11' then follows this change by virtue of spring plate 29', a stable connection can continue to be assured. This applies, in particular, for the case described herein where the temperature is 220° C., a temperature that the metal of the fuser roller can actually reach during operation. It is evident that there is even more latitude for higher temperatures.

Pressure against the flange 11 and the connecting elements 13 and thus against the body 12 is assured, especially in the embodiment with chamfers 16 and 17 on the offset 25 and the annular groove 14, and this pressure cannot lead to a tilting of the connecting elements 13 with a resulting non-concentric operation of the fuser roller 3. Also, in this embodiment, no torque can develop that works on the connecting elements 13, because the contact point between the connecting element 13 and the annular groove 14 lies inside of the surface of the chamfer 17. In the embodiment without chamfers 16 and 17 the edge of the annular groove 14 would serve as the contact point, around which a torsional moment could be developed.

The present invention assures the establishment of a stable connection between the flange 11 and the body 12 of a fuser roller 3, which remains stable and does not develop stresses, even when the fuser roller 3 is heated to temperatures of 220° C., e.g., that are necessary for the fusing process. Because the connecting elements 13 are able to follow the expansions, and the flange 11 follows these changes by the spring plate 29, the flange 11 and the body 12 can expand without constraint and without exercising commensurate forces upon one another that could lead to stresses and warping. This enables the achievement of better outer surface textures for the fuser roller 3 even at higher temperatures and at the least, an improved running pattern. Preventing expansions inside the connection expands its durability.

The invention has been described in detail with particular reference to certain preferred embodiments thereof, but it will be understood that variations and modification can be effected within the spirit and scope of the invention.

What is claimed is:

1. Fuser roller (3) for a printing machine with internal heating elements, which has a cylindrically shaped body (12) and which has flanges (11) that close off the ends, comprising: a connection that incorporates at least one substantially ball-shaped connecting element (13), for the body and the flanges, that is movable in a rolling motion relative thereto to balance out, in every direction possible, environmentally induced changes in the sizes of said body and said flanges.

2. Fuser roller (3) as in claim 1, wherein said body (12) of the fuser roller (3) has an annular groove (14) with a half circular cross section in the vicinity of the connection area of said flange (11) and said body (12), which holds said ball-shaped connecting element (13).

3. Fuser roller (3) as in claim 1, wherein said flange (11) can be inserted into the inside of said body (12) at the end of said body (12); and further including a spring plate (29) placed on the outer side of the end of said body (12) to attach said flange (11) that has been inserted into said body (12).

4. Fuser roller (3) as in claim 2, wherein said flange (11) has on its rim that faces toward the inner side of said body (12), a quarter-circular shaped offset (25) that is matched to the shape of said ball-shaped connecting element (13).

5. Fuser roller (3) as in claim 4, further including chamfers (16,17) on the edges of said half-circular shaped annular groove (14) and/or on the edges of said quarter-circular shaped offset (25).

6. Fuser roller (3) as in claim 5, wherein said chamfers (16,17) have an angle between 0° and 45°, preferably between 15° and 20° relative to the vertical.

7. Fuser roller (3) as in claim 1, further including heat ray (28) reflecting reflector elements on the side of said flange (11) that faces the inside of said body (12), said reflector elements arranged as ring shaped reflector segments (27) on a reflector plate (18).

* * * * *